US006640944B2

(12) United States Patent
Adams

(10) Patent No.: US 6,640,944 B2
(45) Date of Patent: Nov. 4, 2003

(54) RIGID AND COLLAPSIBLE DIVIDER FOR PORTABLE RECEPTACLE

(75) Inventor: Donna M. Adams, 1379 Zeb Bryson Rd., Clarkesville, GA (US) 30523

(73) Assignee: Donna M. Adams, Clarkesville, GA (US)

( * ) Notice: Subject to any disclaimer, the term of this patent is extended or adjusted under 35 U.S.C. 154(b) by 0 days.

(21) Appl. No.: 08/951,979

(22) Filed: Oct. 16, 1997

(65) Prior Publication Data

US 2003/0103691 A1 Jun. 5, 2003

(51) Int. Cl.[7] ..... A45C 3/00
(52) U.S. Cl. ..... 190/110; 150/113
(58) Field of Search ..... 150/113, 112, 150/116; 190/110, 109

(56) References Cited

U.S. PATENT DOCUMENTS 3,381,782 A * 5/1968 Ikelheimer ..... 190/110 X
4,210,186 A * 7/1980 Belenson ..... 190/110 X
4,239,146 A * 12/1980 Goranson ..... 229/15
4,260,004 A * 4/1981 Domke ..... 150/113 X
4,506,769 A * 3/1985 Franco et al. ..... 190/110 X
4,610,286 A * 9/1986 Cyr ..... 190/110 X
4,842,032 A * 6/1989 Mastronardo ..... 206/309
5,181,612 A * 1/1993 Liu ..... 206/546
D348,390 S * 7/1994 Van Ness ..... D9/346
5,325,602 A * 7/1994 Nainis et al. ..... 34/287
5,356,004 A * 10/1994 Weinreb ..... 150/113 X
5,860,525 A * 1/1999 Bellehchili ..... 206/443
5,896,962 A * 4/1999 Smith et al. ..... 190/107

* cited by examiner

*Primary Examiner*—Jes F. Pascua

(57) ABSTRACT

Disclosure relates to a rigid and foldable insert for a portable receptacle, where the insert includes plural, selectively positioned, panels fastened therewithin by complementary fabric strips, such as a VELCRO-type fastener. A preferred embodiment thereof includes a separable bottom panel.

10 Claims, 2 Drawing Sheets

RIGID AND COLLAPSIBLE DIVIDER FOR PORTABLE RECEPTACLE

FIELD OF THE INVENTION

This invention relates to portable receptacles, rigid and flexible, and more particularly to a divider or organizer to be inserted therein to provide plural compartments.

BACKGROUND OF THE INVENTION

The present invention relates to both rigid and flexible, portable receptacles, and particularly to a collapsible and removable insert for placement therein, where typical receptacles may be selected from rigid-like coolers, to flexible-like bags, such as purses and related type fabric bags. A feature hereof is the provision of a rigid, yet foldable insert having removably attached panels to divide the insert into plural compartments.

The prior art, as reflected in the following patents, teach a number of collapsible or compartmented receptacles. However, none are directed to a collapsible insert for easy use with existing receptacles.

Such prior art patents are a.) U.S. Patent No. D-348,390, to Van Ness, discloses a collapsible box, such as may be placed in the trunk of an automobile, for holding and transporting groceries in bags.

b.) U.S. Pat. No. 5,325,602, to Nainis et al., discloses a very specific use box. The box thereof relates to a carton for holding wet books and like materials during transport to and processing at a freezing and freeze drying or vacuum drying facility. The carton is fabricated as a laminated corrugated carton from a high density polymer that may be stored in a flat condition, assembled to hold the books or like materials and after their processing collapsed for storage. The carton has openings throughout to facilitate extraction of fluids.

c.) U.S. Pat. No. 5,181,612, to Liu, discloses a compact lunch box consisting of a collapsible carrier body and a collapsible casing both having walls made of a thermal insulative material. In the erected state, the lower casing may be removably mounted with a plurality of mounting webs at the bottom side of the carrier body for containing food and beverage. In the collapsed state, the lower casing can also be conveniently mounted at the bottom of the carrier body to form a compact assembly which can be stored in a briefcase or a school bag.

d.) U.S. Pat. No. 4,239,146, to Goranson, discloses a collapsible box having foldable wall and bottom assemblies which are connected to opposite sides of a central partition wall. Each wall and bottom assembly includes a main wall, a bottom panel pivoted to the lower edge of the main wall, and foldable sidewalls having one edge pivoted to the side edges of the main wall. The opposite edges of the foldable sidewalls are pivotally but detachably connected to the central partition wall.

A review of the prior art does not reveal any hits or suggestions as to how to provide a foldable insert for a portable receptacle. The manner by which the goals hereof are met by the present invention will become apparent to those skilled in the art from the following description, particularly when read in conjunction with the accompanying drawings.

SUMMARY OF THE INVENTION

The present invention relates to a rigid, yet foldable divider for removable insertion into a portable receptacle.

The divider, also may be called an organizer, comprises four upstanding, planar walls hingedly joined to form a generally rectangular profile in the operative position, a pair of spaced-apart, generally parallel first fabric fastener strips, i.e. VELCRO fastening strips, secured intermediately of the upstanding walls about the inside thereof. Further, there are a plurality of generally rectangular, planar divider inserts having at least a first dimension side equal to a side dimension of at least one upstanding wall. The divider inserts, along a first dimension side, include a complementary second fabric fastener strip, such as VELCRO, whereby the divider inserts may be removably and selectively attached within the four upstanding walls to the first fastener strips to divide the rigid and foldable divider into plural compartments.

Accordingly, a object of this invention is to transform an ordinary and known type of receptacle, such as a fabric-like bag, into a compartmentalized receptacle.

A further object hereof is a receptacle that may be personalized by the user to provide compartments within a receptacle that are sized to meet specific requirements of the user.

These and other objects will become clearer to those skilled in the art from the following specification.

DETAILED DESCRIPTION OF PREFERRED EMBODIMENT

Figure 1:
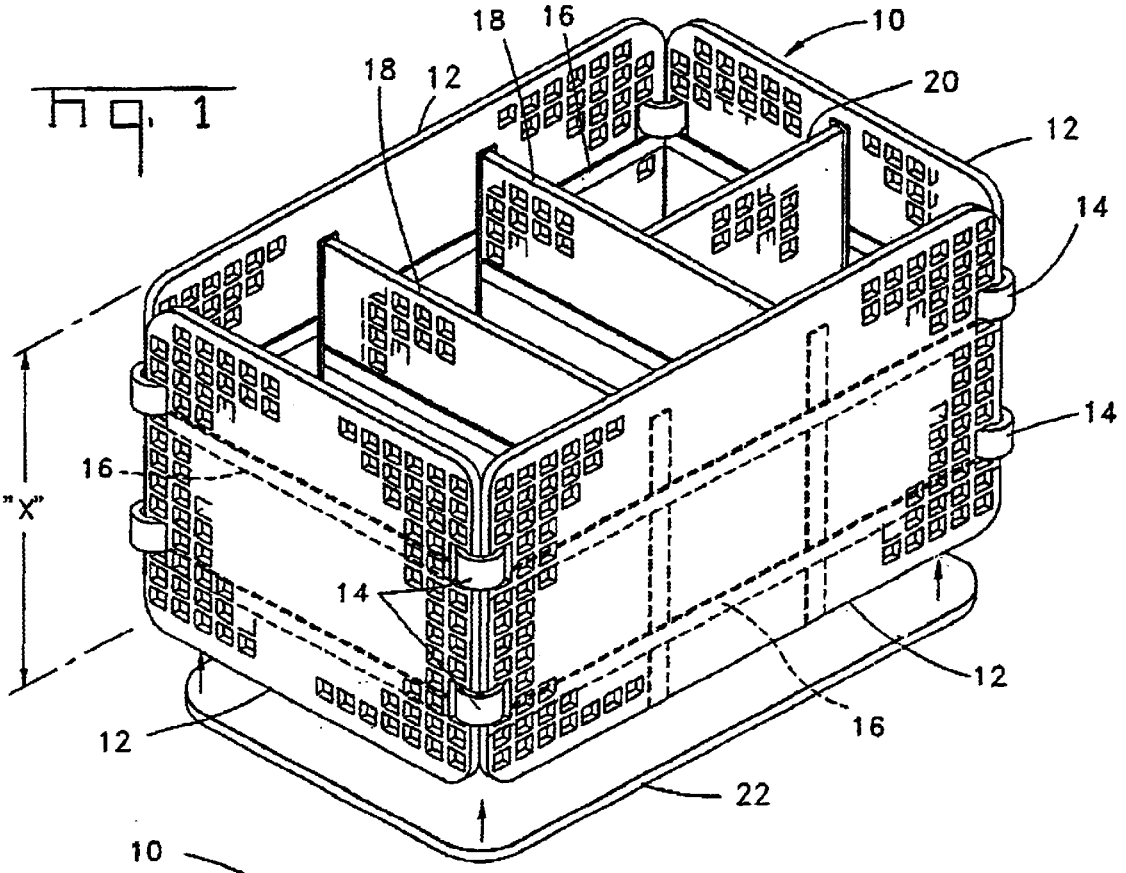
FIG. 1 is a perspective view of a rigid and foldable divider, or organizer, according to the present invention, where, the divider is shown assembled and ready for insertion into a portable receptacle, such as a fabric-like carrying bag.

This invention is directed to a rigid, yet foldable divider insert for a portable receptacle, as illustrated in the several Figures, where like reference numerals represent like features or components throughout the several views.

Figure 2:
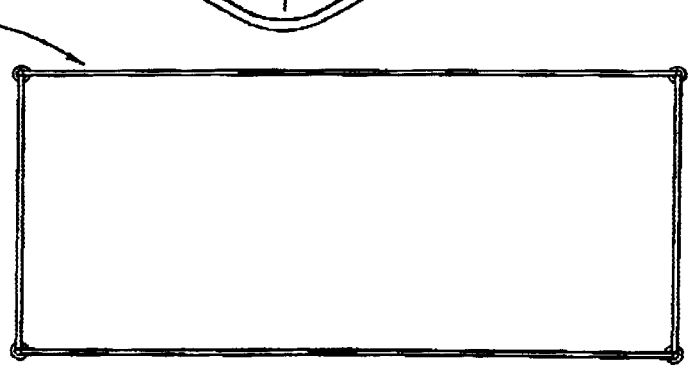
FIG. 2 is a top plan view of the divider hereof, illustrating a generally rectangular profile.

FIG. 1 illustrates a preferred embodiment of the divider insert 10 according to this invention. The divider insert, or organizer, comprises four individual upstanding walls 12, where each said wall includes one common dimension, in this case the vertical dimension "X", and that each wall is joined to adjacent said wall by a pair of hinges 14, which in the operable position has a rectangular profile (FIG. 2). The respective wall panels are planar and preferably formed of a light-weight material, such as a plastic mesh.

On the inside surface of each said wall there is provided first plural fabric fastener strips 16, such as VELCRO, as known in the art. A VELCRO type fastener is one formed by a pair of matable fabric strips, where one such strip includes a plurality of fine hook elements, and its complementary strip includes a dense pile for engagement with said hook elements.

Selectivity positioned within the erected side walls 12 are plural, planar dividers 18 having at least one common side dimension "X", where the commonly dimensioned sides include second or complementary VELCRO-type fastening strips. As best seen in FIG. 1, the user thereof can arbitrarily position the planar dividers 18, two being shown in FIG. 1, and secure same by means of the complementary VELCRO-type strip fasteners. Further, the planar dividers 18 may be provided with plural laterally disposed VELCRO-type fastening strips on both sides thereof. By this arrangement a sub-divider 20 may be used between a respective side wall 12 and divider 18. Even in this case, the sub-divider 20 has one side dimension equal to "X". Finally, to secure same therewithin, the sub-divider 20 is provided with VELCRO-type fastening strips along opposing sides.

Figure 4:
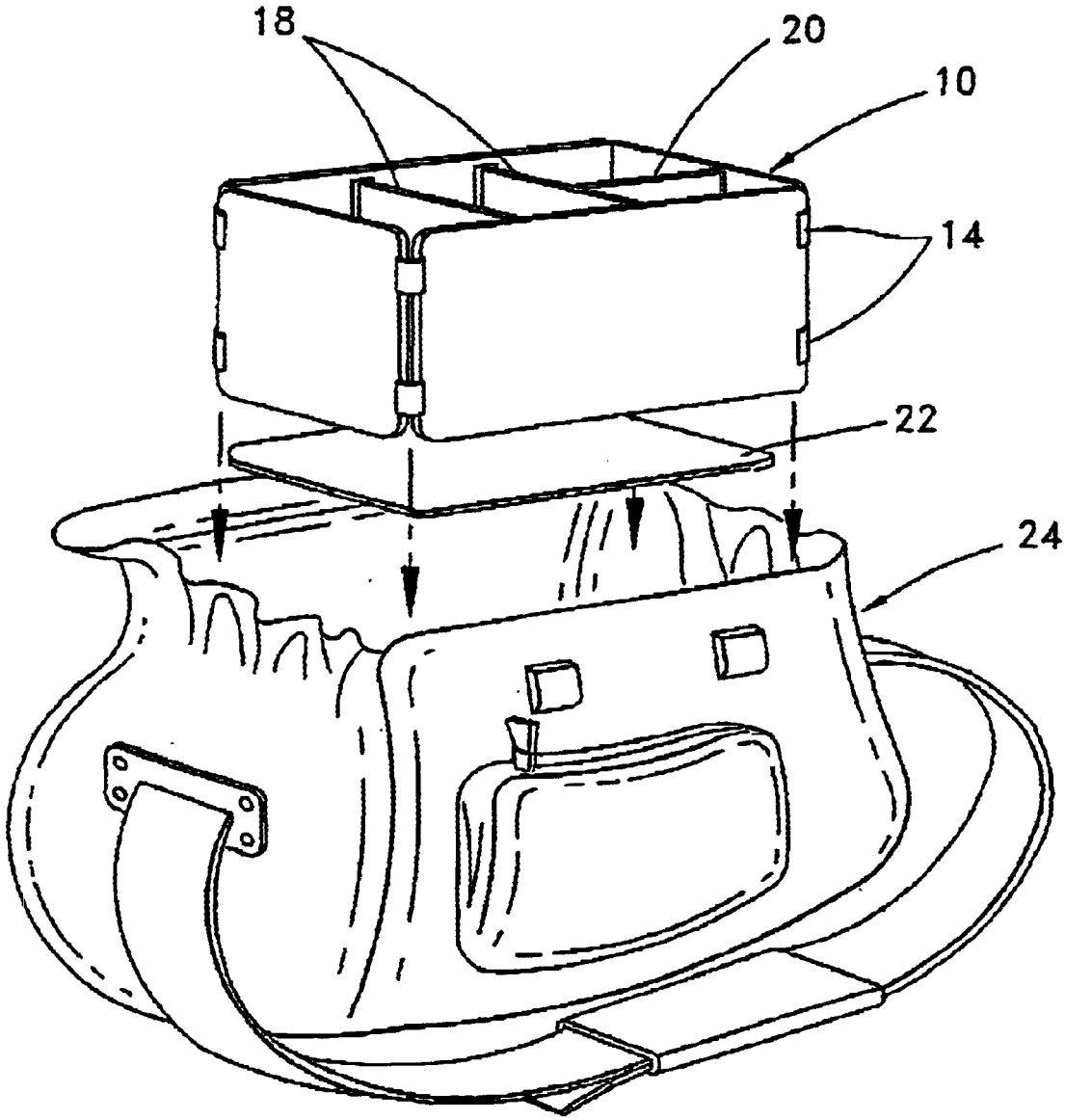
FIG. 4 is a perspective view of the divider hereof where such divider is poised for insertion into a fabric-like carrying bag.

An optional feature of this invention, and to provide additional stability to the divider insert, is a bottom panel 2, sized to be slidably received within the erected divider insert 10. FIGS. 1 and 4 illustrate the relative position of the bottom panel to the divider insert.

Figure 3:
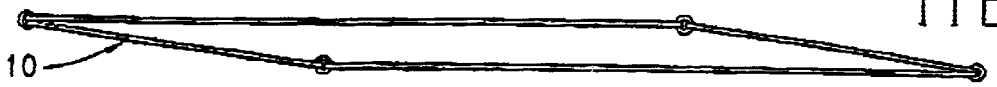
FIG. 3 is a folded divider according to this invention, suitable for storage.

Since a feature of the divider insert hereof is its removability, FIG. 3 shows how the divider insert 10, less the dividers 18 and sub-dividers 20, may be folded into a relatively flat position for storage and later use.

Finally, FIG. 4 illustrates the duly erected and sub-divided insert 10 poised for placement within a fabric-type bag 24, such as may be used as carry-on luggage for an airline trip. The uniqueness of this invention is its versatility, in allowing the user thereof the opportunity to better organize the contents of the bag within individually designed compartments in the bag.

While a preferred embodiment of the invention has been described and illustrated, it is understood that persons skilled in the art may recognize that variations may be made to the insert divider of his invention. Therefore, while the invention has been disclosed in preferred terms only it may be obvious to such persons that additions, deletions and modifications can be made therein without departing from the spirit and scope of this invention, and that no undue limits should be imposed thereon except as set forth in the following claims.

What is claimed is:

1. A rigid and foldable divider for removable insertion into and essentially coextensive with a portable receptacle, said divider comprising four upstanding, planar walls hingedly joined to form a generally rectangular profile in the operative position, a pair of spaced-apart, generally parallel first fabric fastener strips secured intermediately of said upstanding walls about the inside thereof, and a plurality of generally rectangular, planar divider inserts having at least a first dimension side equal to a side dimension of at least one said upstanding wall, said divider inserts along said first dimension side including a complementary second fabric fastener strip, said divider inserts may be removable and selectively attached within said four upstanding walls to said first fastener strips to divide same into plural compartments.

2. The rigid and foldable divider according to claim 1, wherein said upstanding walls are rectangular having at least two common side dimensions, and that adjacent said walls are joined along one of said common sides.

3. The rigid and foldable divider according to claim 1, including a removable bottom panel essentially equal to said profile.

4. The rigid and foldable divider according to claim 1, wherein at least a first of said divider inserts further includes first said type of fabric fastener strips planarly aligned with said first fabric fastener strips.

5. The rigid and foldable divider according to claim 4, wherein a first said insert is essentially coextensive with each of an opposing pair of said upstanding walls, and a second said insert is removably attached between said first insert and one of said opposing walls.

6. The rigid and foldable divider according to claim 1, wherein said upstanding walls and said inserts are fabricated from light weight plastic mesh panels.

7. In combination with a portable receptacle, an organizer for partitioning said receptacle into compartments, said organizer comprising a removable bottom panel disposed within said receptacle, four upstanding, planar walls hingedly joined to form a generally rectangular profile in the operative position, where said walls are operably positioned over said bottom panel, a pair of spaced-apart, generally parallel first fabric fastener strips secured intermediately of said upstanding walls about the inside thereof and a plurality of generally rectangular, planar divider inserts having at least a first dimension side equal to a side dimension of at least one said upstanding wall, said divider inserts along said first dimension side including a complementary second fabric fastener strip, whereby said divider inserts may be removably and selectively attached within said four upstanding walls to said first fastener strips to divide same into plural compartments.

8. The combination according to claim 7, wherein said receptacle is a flexible, fabric-like receptacle.

9. The combination according to claim 7 wherein at least a first of said divider inserts further includes first said type of fabric fastener strips planarly aligned with said first fabric fastener strips.

10. The combination according to claim 9, wherein a first said insert is essentially coextensive with each of an opposing pair of said upstanding walls, and a second insert is removably attached between said first insert and one of said opposing walls.

* * * * *